US006598611B1

(12) United States Patent
Durazzani

(10) Patent No.: US 6,598,611 B1
(45) Date of Patent: Jul. 29, 2003

(54) DISHWASHING MACHINE, IN PARTICULAR FOR HOME USE, HAVING A FUNCTIONAL LOADING DOOR

(75) Inventor: Piero Durazzani, Porcia (IT)

(73) Assignee: Electrolux Zanussi S.p.A., Pordenone (IT)

( * ) Notice: Subject to any disclaimer, the term of this patent is extended or adjusted under 35 U.S.C. 154(b) by 0 days.

(21) Appl. No.: 10/048,867

(22) PCT Filed: Jun. 20, 2000

(86) PCT No.: PCT/EP00/05650

§ 371 (c)(1),
(2), (4) Date: Apr. 22, 2002

(87) PCT Pub. No.: WO01/10284

PCT Pub. Date: Feb. 15, 2001

(30) Foreign Application Priority Data

Aug. 5, 1999 (IT) ..... PN99A0064

(51) Int. Cl.[7] ..... A47L 15/42
(52) U.S. Cl. ..... 134/95.2; 134/201
(58) Field of Search ..... 134/95.2, 200, 134/201; 312/228

(56) References Cited

U.S. PATENT DOCUMENTS

| | | | | |
|---|---|---|---|---|
| 2,216,388 A | * | 10/1940 | Hampel | 312/228 |
| 5,365,959 A | * | 11/1994 | Favaro | 312/228 |
| 5,660,195 A | * | 8/1997 | Taylor, Jr. et al. | 134/95.2 |
| 5,836,324 A | * | 11/1998 | Johnson et al. | 134/95.2 X |

FOREIGN PATENT DOCUMENTS

| | | |
|---|---|---|
| DE | 198071 A | 7/1999 |
| EP | 545127 A | 6/1993 |
| EP | 858768 A | 8/1998 |
| WO | 98 33426 A | 8/1998 |

* cited by examiner

*Primary Examiner*—Philip Coe
(74) *Attorney, Agent, or Firm*—Pearne & Gordon LLP

(57) ABSTRACT

Dishwashing machine comprising an outer casing (1) and a loading door (6) which is adapted to only close by means of sliding motions in a direction that is substantially perpendicular to the open front face of the washing vessel of the machine. Within the thickness of the door (6) there are accommodated functional and hydraulic component parts (30, 15, 20, 25, 35, 5, 22, 36). Of some of these component parts, the portions requiring to be reached by the user are arranged along the upper edge (10) of the door (6).

5 Claims, 3 Drawing Sheets

DISHWASHING MACHINE, IN PARTICULAR FOR HOME USE, HAVING A FUNCTIONAL LOADING DOOR

This application claims the benefit of International Application Number PCT/EP00/05650, which was published in English on Feb. 15, 2001.

DESCRIPTION

The present invention relates to a dishwashing machine, particularly, although not solely for home use.

The great majority of home-use dishwashing machines currently sold on the market have all of the following three construction features:

a) the open front face of the washing vessel is adapted to be closed by a loading door hinged according to a horizontal axis close to the floor, and therefore with a rotation of such a door by an angle of approx. ninety degrees directed from bottom to top, ie. upwards;

b) the washing and rinsing aid dispensers, which are accommodated within the thickness of the loading door, are accessible by the user, for filling them up, through proper apertures with respective lids provided on the inner door;

c) the water softer device is arranged behind the socle or plinth of the machine, so that the aperture for filling in the salt in the appropriate reservoir, which is part of the water softener device, is located in the lower face (bottom) of the washing vessel.

Notwithstanding the very large diffusion enjoyed on the marketplace, this kind of construction of a dishwashing machine is rather unsatisfactory from the point of view of overall convenience of use, since the operations that the user is required to perform in order to fill the above mentioned substances in the machine are at least awkward, if not wearisome to be carried out by elderly or, anyway, scarcely dexterous people.

Dishwashing machines intended to reduce the extent of these drawbacks have been proposed, which however still feature the peculiarity indicated under a) above, ie. the loading door hinged on to the bottom portion of the machine. In particular:

in the European patent EP-A-0 545 127 a part of the water-carrying circuit is housed within the thickness of the loading door and comprises a ion-exchange water softener, a salt reservoir and a water metering device for the regeneration of the ion-exchanging resins. In correspondence of the hinging axis of the door use is then made of quick-fitting means for connection with the remaining part of the same water-carrying circuit, which is conventionally housed in the outer casing of the machine, under the washing vessel thereof. Such connection means are clearly subject to wear-down, with a resulting risk of flooding, owing to the door being repeatedly opened and closed. Since the aperture of the salt reservoir is located on the inner door of the machine, the filling in of salt by the user must be carried out using due care and attention, which are not always ensured to the desired extent considering that the door must be at the same time kept in a partially opened position in the absence of any checking or retaining means;

in the invention described in US-A-5 755 244 and the number of patents correlated therewith, a dishwashing machine is constituted by two modular units arranged upon each other and complete of all pertaining functional component parts, except for those concerning the water softener. The greater complexity of the construction of a machine of this kind is fully apparent here, along with the related higher manufacturing and servicing costs, owing to said component parts being practically multiplied by two;

in the European patent application EP-A-0 858 768, the dishwashing machine has a loading door that is provided on top with a control panel having an increased thickness, which houses both the control devices and the washing product and rinsing aid dispenser, whereas all component parts pertaining to the water softening function are quite conventionally arranged behind the socle of the machine, under the washing vessel. As a result, such a machine does not actually introduce any improvement in terms of convenience of use as far as the filling in of salt is concerned, while even the filling in of detergent and rinsing aid must in any way be made with the loading door kept in a partially opened position.

It is therefore a main purpose of the present invention to provide a dishwashing machine in which the operations that must be performed by the user in view of filling in salt, washing and rinsing aids, as well as maintenance, servicing and/or repair are particularly facilitated thanks to a more rational construction of the loading door.

A further purpose of the present invention is to make the construction of a dishwashing machine more rational so as to make it more easily and economically manufacturable on a mass production scale.

A dishwashing machine with the features as recited in the appended claims enables these and further aims to be reached, as this will be shown in the description of a preferred embodiment that is given below by way of non-limiting example with reference to the accompanying drawings, in which:

Figure 1:
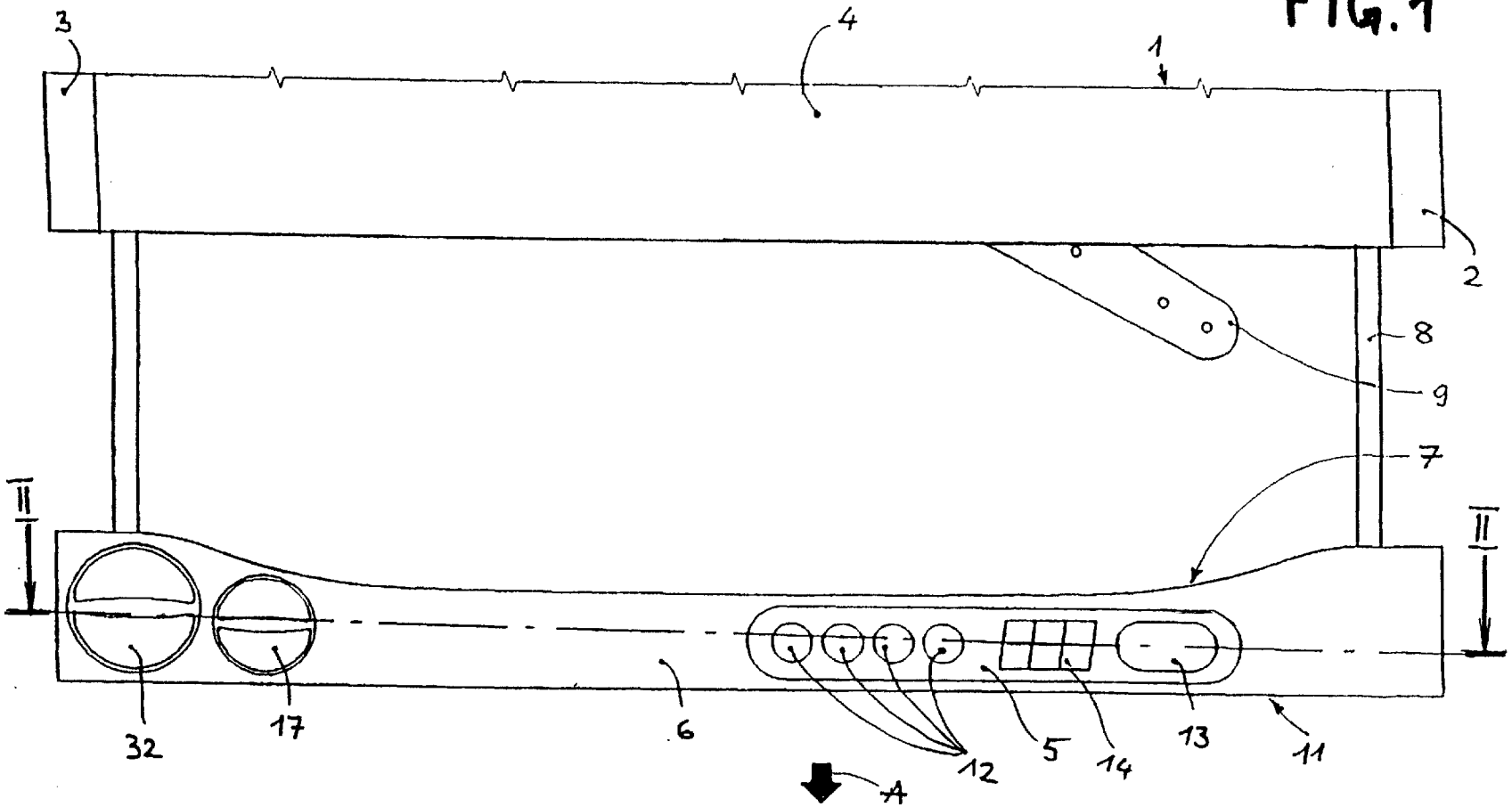
FIG. 1 is a top view of the sole front portion of a dishwashing machine according to the present invention with its loading door half-opened.

In a conventional manner, the outer casing 1 of a dishwashing machine according to the present invention is in the shape of substantially a parallelepiped owing to its being formed, among other things, by the right-hand side wall 2, the left-hand side wall 3 and the top wall 4. The washing vessel has in turn its front face open, so as to allow for the washload items to be loaded thereinto, and adapted to be closed by a door 6. However, as opposed to conventional dishwashing machines, the door 6 is in this case adapted to slide in a direction that is perpendicular to said front face of the washing vessel, ie. it is opened by a sliding motion occurring in the sensibly horizontal direction of the arrow A—see FIG. 1.

Furthermore, in accordance with the teachings of the Italian patent application no. PN99A000043, filed on Jun. 1, 1999 by this same Applicant, a body 8 having a pan-like or similar shape, as illustrated also in FIG. 3, extends from the lower portion of the inner surface or liner 7 of the door 6 towards the interior of the outer casing 1. This body 8 forms the bottom of the washing vessel and supports at least one of the rotating spray arms 9 that are provided to spray washing and rinsing liquor onto the washload items during the operation cycles of the machine. It should incidentally be noticed that, again in accordance with the teachings of the above cited Italian patent application, said door liner 7 is adapted to support, above said body 8, at least one of the racks provided for the washload items to be arranged therein (not shown in the Figure for reasons of greater simplicity).

According to a basic feature of the present invention, many of the functional component parts, both electric and hydraulic, are accommodated within the thickness of the door assembly.

Figure 2:
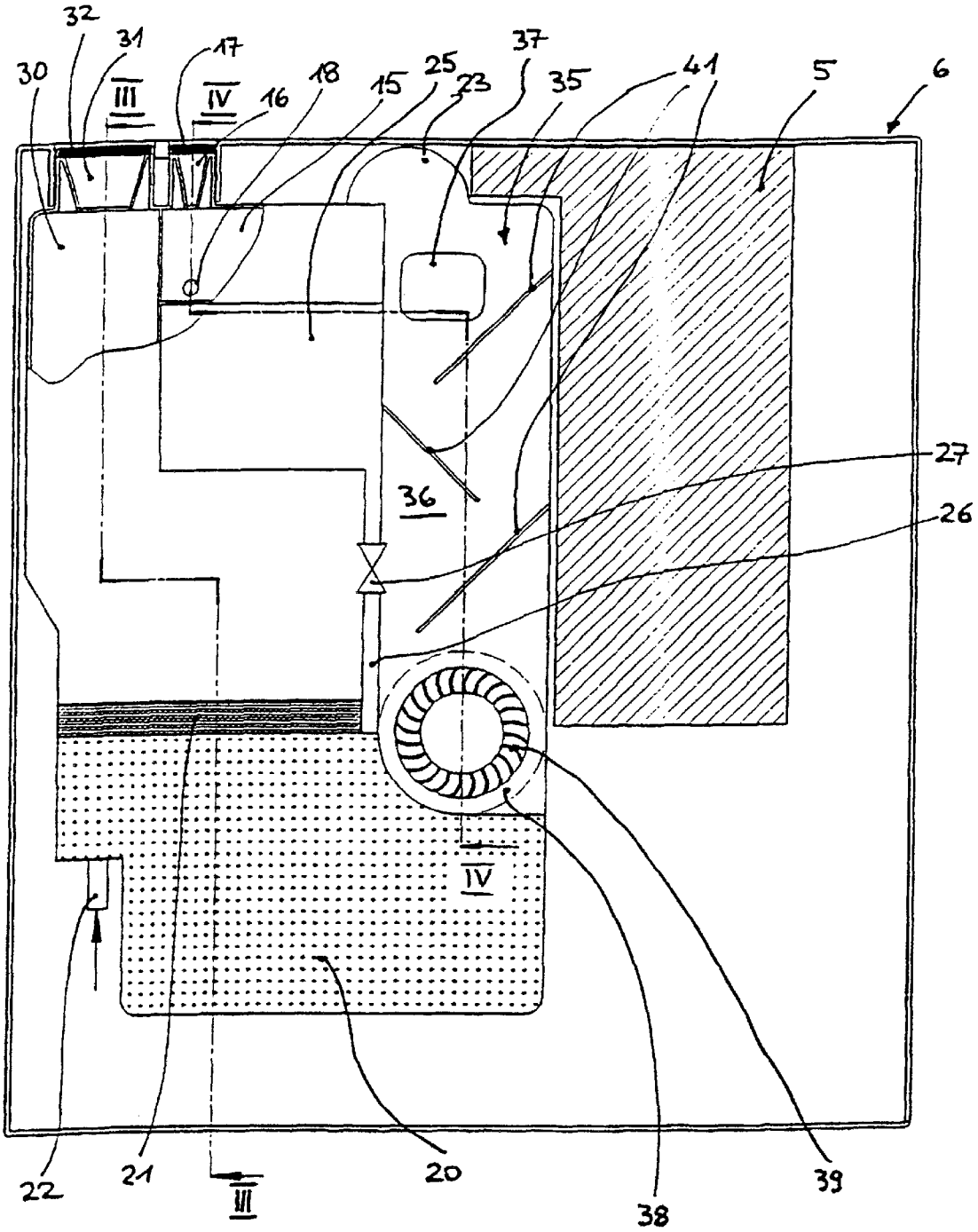
FIG. 2 is a cross-sectional view, on another different scale, of the door along the II—II line of FIG. 1, in which some component parts are shown in a simplified manner.

Namely, in the door 6 there are arranged not only, as already known in the art, the control and regulation unit 5 of the machine, the multi-dose rinse-aid dispenser 15, with a dispensing port 18 provided inside the washing vessel, the water softening apparatus 20, of the type based on ion-exchanging resins, the salt reservoir 30 for the periodical regeneration of said resins, the metering reservoir 25 for the regeneration water, but also:

the means 35, provided in a branch-out arrangement from the washing vessel, for drying the washload items in the final phase of the operating cycle of the machine—see FIGS. 1 and 2, means (not shown for reasons of greater simplicity) of the volumetric meter type for controlling the amount of water let into the machine in the various phases of its operating cycle.

The water from the water supply mains reaches the above cited component parts housed within the door assembly 6 through a fixed connection fitting 22 and a commonly known air-break arrangement 23, after having flown through an electromagnetic valve (not shown) and a flexible hose (not shown, either) connected to the water supply pipe, eg. in the zone of the machine that is situated under the washing vessel behind the socle or plinth of the outer casing 1.

Between the salt reservoir 30 and the water softener 20 there is arranged a filter 21 (see FIG. 3), while the connection between the metering reservoir 25 (which is arranged below the multi-dose rinse-aid dispenser 15) of the water for the regeneration of the ion-exchange resins and the water softener 20, via the filter 21, is ensured by a conduit 26 provided with an electromagnetic valve 27, which is controlled by the programme sequence control switch that is part of the control and regulation unit 5 of the machine—see FIG. 2.

The washload drying means 35 comprise a vertical conduit 36, which is 20 provided in a branching-off arrangement with respect to the washing vessel since, when the latter is closed by the door, said conduit 36 is arranged to directly communicate with the interior of said washing vessel via a first aperture 37, in the upper portion thereof, and a second aperture 38, in the lower portion thereof.

Figure 4:
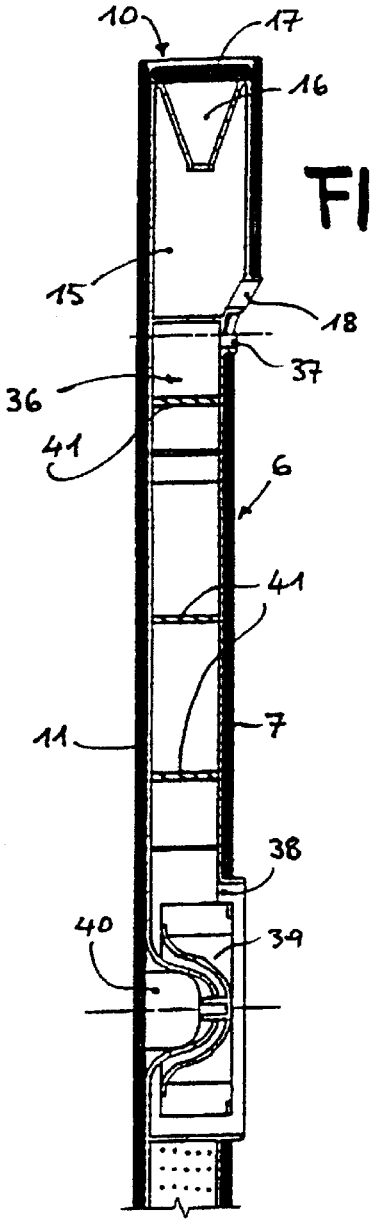
FIG. 4 is a cross-sectional view of the door according to the IV—IV line of FIG. 2.

As it can be seen in FIG. 4, the inner wall of the conduit 36 is in a heat-conduction relation with the door liner 7, whereas the outer wall thereof is in a heat-conduction relation with the outer surface of the door assembly 6, which in other words means that it is cooled by the air of the ambient around the machine.

During the drying phase that concludes the operating cycle of the machine, a fan 39, arranged in the conduit and driven by an electric motor 40, is adapted to take into the same conduit, through said first aperture 37, the moist air existing inside the washing vessel, and to recycle dried air through said second aperture 38. The low temperature of the outer wall 11 of the door 6, and therefore of the thereto associated wall of the conduit, is in fact effective in causing the vapour to condense inside the conduit 36, owing also to the presence of stationary baffles 41, acting as dripping means, inside the same conduit 36—see FIGS. 2 and 4.

According to another feature of the present invention, those portions of all afore cited component parts which require being acceded to by the user are arranged along the upper edge 10 of the door assembly 6, so as to become readily accessible upon opening the same door.

Figure 3:
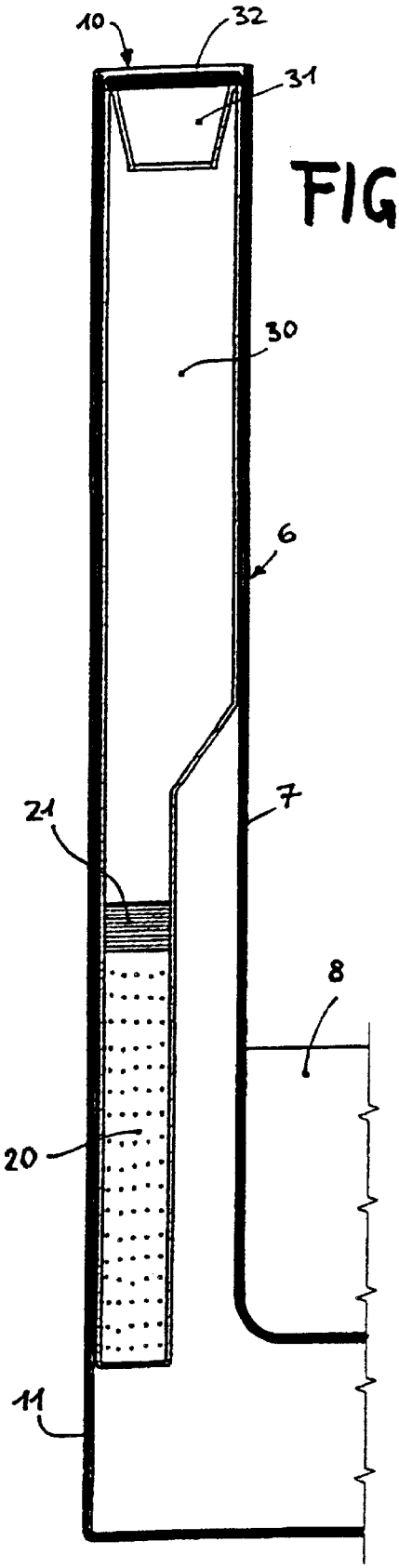
FIG. 3 is a cross-sectional view of the door according to the III—III line of FIG. 2.

More precisely, on the side of the left-hand wall 3 of the outer casing 1 there are provided, in a side-by-side arrangement, a first funnel-like aperture 31 for filling salt into the reservoir 30 and a second funnel-like aperture 16 for filling rinse aid into the multi-dose dispenser 15, said apertures being of course duly provided with respective covers or caps 32 and 17—see FIGS. 2, 3 and 4.

Along the same upper edge 10, in a position that is closer to the right-hand wall 2 of the outer casing 1, there are on the contrary provided control means 12 and 13 and associated indicating means 14 of the unit 5. Included among these control means there of course is also the main on/off switch of the machine, while the indicating means may for instance include an alphanumeric display—see FIG. 1.

The operating cycle of the machine according to the present invention is substantially a traditional one, so that it only needs to be described in a broad outline here.

During the washing and rinsing phases, the supply water that arrives from the water supply line through the fitting 22 and the air-break arrangement 23 after having been softened in the water softener apparatus 20, is let into the washing vessel, where it mixes up with the washing aid, as delivered by an appropriate dispenser (not shown) or the rinsing aid, which flows in from the dispenser 15 through the dispensing port 18.

During the drying phase, the vapour rising from the washload items is subtracted by the air flowing into and circulated inside the washing vessel, and then caused to condense, as already described, by the action of the already afore described drying means 35.

Finally, it is the amount of water, which has filled the metering reservoir 25 in the preceding phases of the operating cycle, that provides for the regeneration of the ion-exchange resins by flowing down along the conduit 26, after the electromagnetic valve 27 has been actuated to open, so as to dissolve the salt deposited onto the filter 21.

A dishwashing machine according to the present invention has following advantages:

the great convenience of use; in particular, the operations that the user is required to perform in order to fill in the rinse aid and the salt are extremely easy to carry out, since they are performed with the door well open, without any need arising for the latter to be kept in balance in an intermediate opening position, and without any need for the user to stoop;

the operations required to service and/or repair the hydraulic and functional component parts that are housed in the door assembly, are for the same reasons facilitated and capable of being carried out more quickly;

the hydraulic, ie. water connections are in all cases fixed, so that no wear-down risk actually exists at the points where the component parts housed in the door assembly come to interface the corresponding component parts housed in the outer casing, eg. under the washing vessel;

the production of the entire dishwashing machine can be made more rational, since the whole door assembly, ie. inclusive of the afore described functional and water-handling component parts, can be manufactured separately as a self-contained, apart tested subassembly, before being eventually associated to the outer casing.

Although the invention has been described here with reference to a currently preferred embodiment thereof, it will be readily appreciated that it can be implemented in a number of different embodiments, as those skilled in the art may well be capable to develop successively, without departing from the scope of the present invention.

What is claimed is:

1. Dishwashing machine comprising an outer casing, a washing vessel having an open front face which is closed by means of a loading door only by means of a sliding motion of the door in a direction that is substantially perpendicular to the open front face of the washing vessel, and within the thickness of the loading door there are provided functional and water-handling component parts, characterized in that portions of the component parts that require accessibility by the user are arranged along an upper edge of the door, so as to be accessible from above by the user upon opening the door, and further characterized in that within the thickness of the door there are also provided means for drying the washload items within the dishwashing machine.

2. Dishwashing machine according to claim 1, characterized in that the means for drying the washload items include means adapted to ensure a forced circulation of the moist air released by the washload items into at least a conduit provided in a branch-off arrangement from the washing vessel, where the water vapour contained in the air is caused to condense.

3. Dishwashing machine according to any of the preceding claims, characterized in that it comprises flexible water-supply hoses that are directly connected with the interior of the loading door through fixed interfacing means.

4. Dishwashing machine according to claim 3, characterized in that it comprises means for controlling the amount of water filled into the washing vessel of the machine during washing and rinsing phases of the operating cycle thereof, the means for controlling being also housed within the thickness of the loading door.

5. Dishwashing machine according to claim 1, characterized in that along the upper edge of the loading door there are also arranged, so as to be accessible by the user, at least a part of the control means and the associated indicating means of the control and regulation unit of the machine, the control means and the associated indicating means also accommodated within the thickness of the loading door.

* * * * *